US007374166B2

(12) United States Patent
Inoue

(10) Patent No.: US 7,374,166 B2
(45) Date of Patent: May 20, 2008

(54) SHEET CONVEYING UNIT, AND IMAGE READING UNIT, POST-PROCESSING UNIT, AND IMAGE FORMING APPARATUS EMPLOYING THE SHEET CONVEYING UNIT

(75) Inventor: Nobuo Inoue, Chiba (JP)

(73) Assignee: Ricoh Company, Limited, Tokyo (JP)

( * ) Notice: Subject to any disclaimer, the term of this patent is extended or adjusted under 35 U.S.C. 154(b) by 443 days.

(21) Appl. No.: 10/942,836

(22) Filed: Sep. 17, 2004

(65) Prior Publication Data

US 2005/0087923 A1 Apr. 28, 2005

(30) Foreign Application Priority Data

Sep. 17, 2003 (JP) ..... 2003-323892

(51) Int. Cl.
*B65H 5/00* (2006.01)

(52) U.S. Cl. ..... 271/264

(58) Field of Classification Search ..... 271/264, 271/208

See application file for complete search history.

(56) References Cited

U.S. PATENT DOCUMENTS 5,974,290 A 10/1999 Inoue
5,984,305 A 11/1999 Inoue
6,663,099 B2 12/2003 Inoue
6,701,104 B2 3/2004 Chikano
6,711,377 B2 3/2004 Yamagishi
6,792,226 B2 9/2004 Chikano

FOREIGN PATENT DOCUMENTS

| | | | |
|---|---|---|---|
| JP | 56-83861 U | | 11/1979 |
| JP | 60-171949 | | 9/1985 |
| JP | 2-75443 U | | 6/1990 |
| JP | 03259861 A | * | 11/1991 |
| JP | 7-215523 | | 8/1995 |
| JP | 09-054484 | | 2/1997 |
| JP | 2000-344414 | | 12/2000 |
| JP | 2003-246490 | | 9/2003 |

* cited by examiner

*Primary Examiner*—David H Bollinger
(74) *Attorney, Agent, or Firm*—Oblon, Spivak, McClelland, Maier & Neustadt, P.C.

(57) ABSTRACT

A sheet conveying unit includes a lower sheet conveying guide on which a sheet material is placed. The sheet conveying unit conveys the sheet material while the sheet material is being guided by the lower sheet conveying guide. The lower sheet conveying guide includes an opening. An elastic member projecting from above toward the lower sheet conveying guide is provided at a downstream side of the opening.

12 Claims, 7 Drawing Sheets

SHEET CONVEYING UNIT, AND IMAGE READING UNIT, POST-PROCESSING UNIT, AND IMAGE FORMING APPARATUS EMPLOYING THE SHEET CONVEYING UNIT

CROSS-REFERENCE TO RELATED APPLICATIONS

The present document incorporates by reference the entire contents of Japanese priority document, 2003-323892 filed in Japan on Sep. 17, 2003.

BACKGROUND OF THE INVENTION

1) Field of the Invention

The present invention relates to a sheet conveying unit that conveys a sheet of recording medium in an image reading unit, a post-processing unit, and an image forming apparatus.

2) Description of the Related Art

In an image forming apparatus such as a copying machine, for example, a sheet material is placed on a sheet conveying guide, the material is conveyed while being guided by the sheet conveying guide, a toner image formed, for example by an image forming unit, is transferred on the sheet material to form an image on the sheet material, and the sheet material with the formed image is discharged to the image forming apparatus main unit to be stacked on, for example, a tray.

Recently, however, for the purpose of resource saving or cost reduction, recycled paper or the back side of used paper is frequently utilized. When an image forming apparatus is used for such recycled sheets of paper over a long period of time, it often results in deposition of paper dust generated in the course of conveyance of sheet materials on a sheet conveying guide.

Particularly, when the sheet conveying guide is provided with a curved portion, since a sheet material hits the sheet conveying guide at the curved portion, or it is bent or rubbed by the curved portion, paper dust adhered to an end surface (a cut edge face) or a surface of the sheet material drops and deposits, particularly on the curved portion or the like.

When paper dust is deposited on the sheet conveying guide as described, the paper dust adheres to another sheet in conveyance again, so that a frictional coefficient of a conveying roller is lowered and a deviation occurs in conveyance of the sheet material.

When deposited paper dust adheres to a sheet material in conveyance again to enter in an image preparing unit, for example, in an electrostatic photography type image forming apparatus, there is a problem of occurrence of such an abnormal image that, when paper dust adheres on an image carrier and the adhered paper dust cannot be completely removed by a cleaning unit, black or white stripes or black or white spots appear on a formed image.

Therefore, a technique for forming a hole for paper dust drop in a sheet conveying guide to allow paper dust to drop from the hole has been proposed (see, for example, Japanese Patent Application Laid-open No. H7-215523).

In the technique, paper dust on a sheet dropping from the hole in the course of conveyance can be removed, however, paper dust which do not drop from the sheet and remains in adhesion thereon cannot be removed and it may drop or deposit in the course of following conveyance of the sheet, which results in contamination inside the image forming apparatus, which further causes lowering of a conveying performance due to skew or increase in slippage rate. In this image forming apparatus, there is such a drawback that the remaining paper dust adheres on an image carrier, or that black or white stripes or black or white spots appear on the image, if the remaining paper dust cannot be completely removed by a cleaning unit.

SUMMARY OF THE INVENTION

It is an object of the present invention to solve at least the above problems in the conventional technology.

A sheet conveying unit according to one aspect of the present invention includes a lower sheet conveying guide on which a sheet material is placed. The sheet conveying unit conveys the sheet material while the sheet material is being guided by the lower sheet conveying guide. The lower sheet conveying guide includes an opening, and an elastic member projecting from above toward the lower sheet conveying guide is provided at a downstream side of the opening.

An image forming apparatus according to another aspect of the present invention includes a sheet conveying unit that includes a lower sheet conveying guide on which a sheet material is placed. The sheet conveying unit conveys the sheet material while the sheet material is being guided by the lower sheet conveying guide. The lower sheet conveying guide includes an opening, and an elastic member projecting from above toward the lower sheet conveying guide is provided at a downstream side of the opening.

An image reading unit according to still another aspect of the present invention includes a sheet conveying unit that includes a lower sheet conveying guide on which a sheet material is placed. The sheet conveying unit conveys the sheet material while the sheet material is being guided by the lower sheet conveying guide. The lower sheet conveying guide includes an opening, and an elastic member projecting from above toward the lower sheet conveying guide is provided at a downstream side of the opening.

A post-processing unit according to still another aspect of the present invention includes a sheet conveying unit that includes a lower sheet conveying guide on which a sheet material is placed. The sheet conveying unit conveys the sheet material while the sheet material is being guided by the lower sheet conveying guide. The lower sheet conveying guide includes an opening, and an elastic member projecting from above toward the lower sheet conveying guide is provided at a downstream side of the opening.

The other objects, features, and advantages of the present invention are specifically set forth in or will become apparent from the following detailed description of the invention when read in conjunction with the accompanying drawings.

DETAILED DESCRIPTION

Exemplary embodiments of a sheet conveying unit, and an image reading unit, a post-processing unit, and an image forming apparatus employing the sheet conveying unit according to the present invention will be explained in detail with reference to the accompanying drawings.

Figure 1:
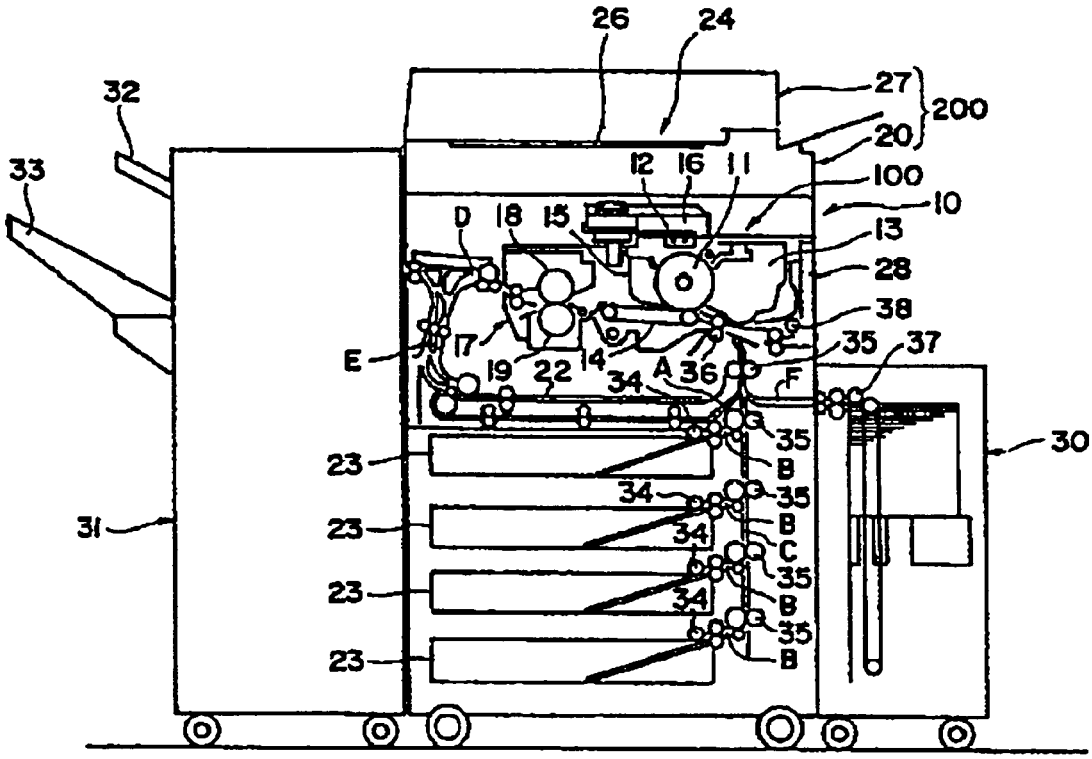
FIG. 1 is a schematic configurational view of a laser copying machine provided with a sheet conveying unit according to the present invention.

FIG. 1 is a schematic configurational view of a laser copying machine (an image forming apparatus) provided with a sheet conveying unit according to the present invention.

As shown in FIG. 1, reference sign 10 denotes a copying machine main unit. An image forming unit 100 is provided in the copying machine main unit 10. The image forming unit 100 is provided with a drum-like image carrier (a photoconductor) 11 and also provided around the image carrier with a charging unit 12, a developing unit 13, a transferring/conveying unit 14, a cleaning unit 15, and the like.

The image forming unit 100 includes a laser writing unit 16. Though not shown, the laser writing unit 16 includes a light source such as a laser diode, a scanning rotary multi-facet mirror which is a polygon mirror, a polygon motor, a scanning optical system such as an fθ lens or a mirror, and the like.

A fusing unit 17 is provided on the left side of the cleaning unit 15 in FIG. 1. The fusing unit 17 includes a fuser roller 18 with a built-in heater and a pressure roller 19 pushing the fuser roller 18 upwardly.

An optical reader 20 is provided in an upper portion of the machine main unit 10. Though not shown, the optical reader 20 includes a light source, a plurality of mirrors, an image forming lens, an image sensor such as a charge coupled unit (CCD), and the like.

On the other hand, a duplexing unit 22 and four-tier paper feed cassettes 23 are provided along a vertical direction in a lower portion of the apparatus main unit 10. Each paper feed cassette 23 receives sheet materials such as paper or OHP sheets. Such a configuration is employed that the duplexing unit 22 communicates with a common paper feeding path C extending from the image carrier 11 downwardly through a sheet re-feeding path A and the paper feed cassette 23 communicates therewith through a feeding path B. A reversing path E branched from a middle way of a sheet discharging path D extending from an outlet of the fusing unit 17 is formed toward the duplexing unit 22.

A contact glass 26 is disposed in an image reading unit 24 on an upper side of the apparatus main unit 10. An automatic document feeder (ADF) 27 is provided on the apparatus main unit 10 so as to allow opening/closing operations and cover the contact glass 26. The ADF 27 and the optical reader 20 constitute an image reading unit 200.

A manual feed tray 28 that guides a manually fed sheet material to a paper feeding path C is provided on a right side of the apparatus main unit 10 so as to allow opening/closing operations. A large capacity paper feeding apparatus 30 is externally provided on the outer side of the apparatus main unit 10, where a large capacity of sheet material is placed so as to allow an up-and-down stacking.

On the other hand, a sheet post-processing unit 31 externally added on the outside of the apparatus main unit 10 is provided on the left side of the apparatus main unit 10. The sheet post-processing unit 31 receives discharged through the sheet discharging path D to discharge them on an upper tier fixed tray 32 as they are or to discharge them on the upper tier fixed tray 32 or a lower tier movable tray 33 after the sheet materials are subjected to such a post-processing as stapling or punching operation.

When copying is performed by the laser copying machine, an original document is set on the ADF 27, or the ADF 27 is opened and an original document is directly set on the contact glass 26. When a document is set on the ADF 27, the document conveyed to the contact glass 26 of the image reading unit 24 by the ADF 27 driven by operating a start switch (not shown) is read for each pixel by the optical reader 20 of the image forming apparatus 200. Alternatively, when a document is set on the contact glass 26 in advance, the set document is read for each pixel by the optical reader 20 of the image forming apparatus 200.

Simultaneously, a paper feed roller 34 selected is rotated to feed a sheet material from a corresponding paper feed cassette 23 of the plurality of paper feed cassettes 23 provided in the apparatus main unit 10 with a multiple-tier configuration, and the sheet material is conveyed to the feeding path C by a conveying roller pair(s) 35 through the feeding path B to be caused to hit a registration roller pair 36 for stopping. The registration roller pair 36 is rotated timely with rotation of the image carrier 11 to feed the sheet material below the image carrier 11 of the image forming unit 100.

Alternatively, a paper feed roller 37 is rotated to feed a sheet material from the large capacity paper feeding apparatus 30, and the sheet material is conveyed to the paper feeding path C by the conveying roller pair 35 through the conveying path F to be caused to hit the registration roller pair 36 for stopping. Alternatively, a paper feed roller 38 positioned at the manual feed unit is rotated to feed a manually fed sheet material set on the manual feed tray 28 opened to the paper feeding path C to be caused to hit the registration roller pair 36 for stopping. The registration roller pair 36 is rotated timely with rotation of the image carrier 11 to feed the sheet material below the image carrier 11 of the image forming unit 100.

On the other hand, when the start switch (not shown) is pressed, simultaneously, the image carrier 11 in the image forming unit 100 is rotated in a clockwise direction on FIG. 1. A surface of the image carrier 11 is first charged by the charging unit 12 uniformly according to the rotation of the image carrier 11, laser beam is then irradiated on the charged surface corresponding to content of the document read by the optical reader 20 to perform writing with the laser writing unit 16, an electrostatic latent image is formed on the surface of the image carrier 11, and toner is thereafter adhered to the latent image by the developing unit 13 to visualize the electrostatic latent image.

As described above, the visualized image is transferred on the sheet material fed below the image carrier 11 by the transferring/conveying unit 14. The image carrier 11 after the image thereon is transferred is cleaned by cleaning unit 15 such that the residual toner is removed thereon, thereby providing for the following similar image forming.

On the other hand, the sheet material with the transferred image is conveyed to the fusing unit 17 by the transferring/ conveying unit 14, where the transferred image is fused on the sheet material with heat and pressure of a fuser roller 18 and a pressure roller 19. Thereafter, the sheet material is discharged to the sheet post-processing unit 31 through the sheet discharging path D.

When images are formed on both surfaces of a sheet material, the sheet material is entered in the reversing path E from a midway of the sheet discharging path D, and is reversed by the duplexing unit 22 to be entered in the paper feeding path C again through the sheet re-feeding path A. The sheet material is again fed to the image forming unit 100 where an image formed on the image carrier 11 separately is transferred on a back surface of the sheet material, and after the transferred image on the back surface is fused in the fusing unit 17, the sheet material is discharged to the sheet post-processing unit 31.

Figure 2:
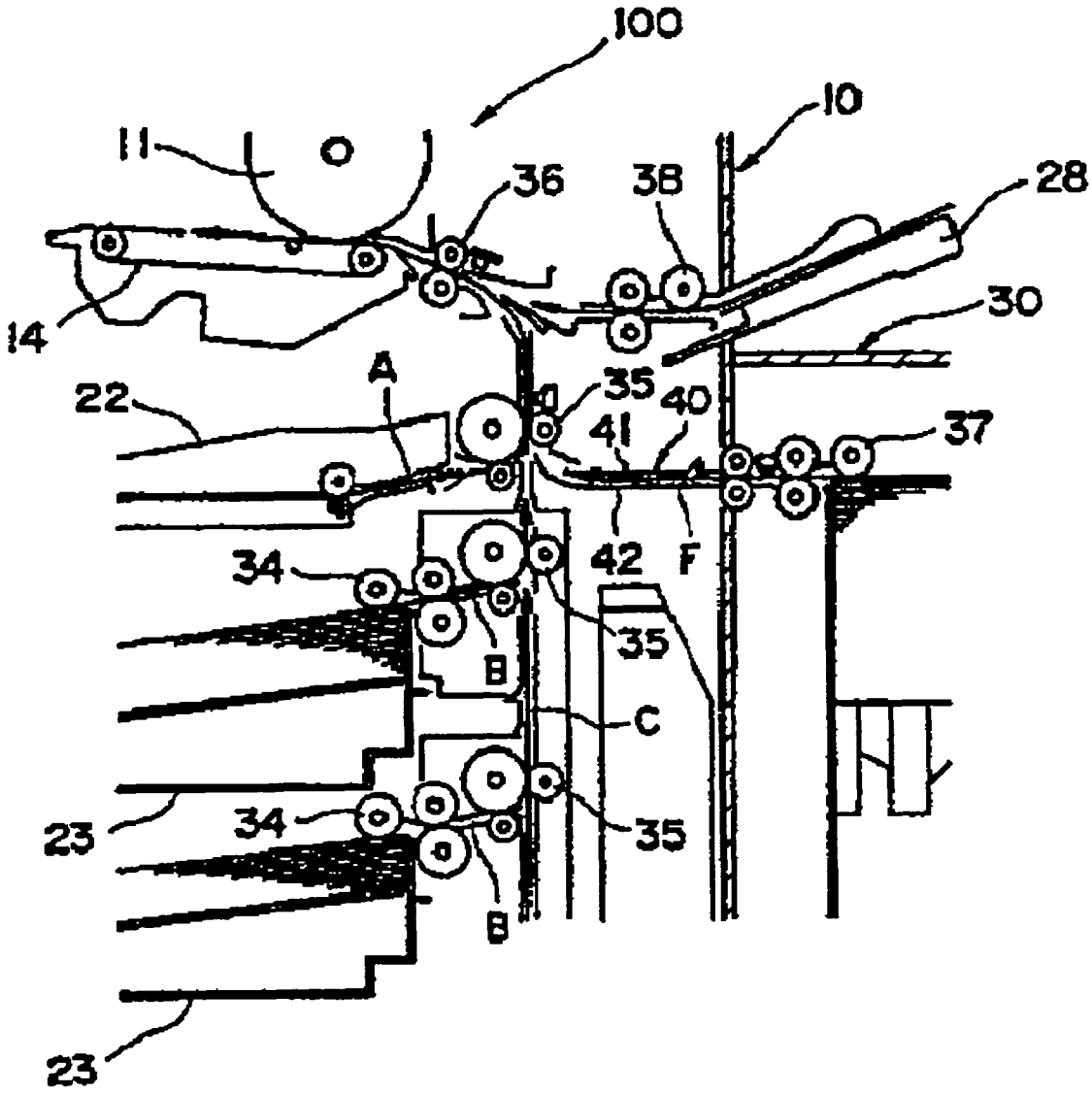
FIG. 2 is an enlarged configurational view of a portion in the laser copying machine shown in FIG. 1 which is positioned upstream of an image forming unit in a sheet conveying direction.

A portion in the laser copying machines shown in FIG. 1, which is positioned upstream of the image forming unit 100 in a sheet conveying direction is shown in FIG. 2 in an enlarged manner.

As shown in FIG. 2, for example, in a sheet conveying unit 40 that guides a sheet material from the large capacity paper feeding apparatus 30 to the paper feeding path C, an upper sheet guide 41 and a lower sheet guide 42 constitutes the conveying path F. The upper and lower sheet guides 41 and 42 are, for example, provided in the apparatus main unit 10 so as to be opposed to each other, and both sides thereof are supported by side plates supporting the image carrier 11, the charging unit 12, the developing unit 13, the cleaning unit 15, and the like.

As described above, at a time of image forming, for example, the paper feed roller 37 is rotated to feed a sheet material out of the large capacity paper feeding apparatus 30, the fed sheet material is put on the lower sheet guide 42 and conveyed through the conveying path F while being guided by the upper and lower sheet guides 41 and 42, and the sheet material is entered in the paper feeding path C to be further conveyed by the conveying roller 35.

In addition, since the sheet re-feeding path A from the duplexing unit 22 also joins at a position at which the conveying path F joins the paper feeding path C, the number of sheet materials passing through the position becomes much large.

Since the conveying path F is sharply curved just before the position, a sheet material hits the lower sheet guide 42 to be bent or rubbed thereby, so that dropping of paper dust from the sheet material is likely at the position. Dropped paper dust eventually deposits on the lower sheet guide 42.

In view of these circumstances, the copying machine main unit 10 shown in FIG. 1 includes the sheet conveying unit 40 shown in FIG. 3 in order to prevent such paper dust from depositing on the lower sheet guide 42.

Figure 3A:
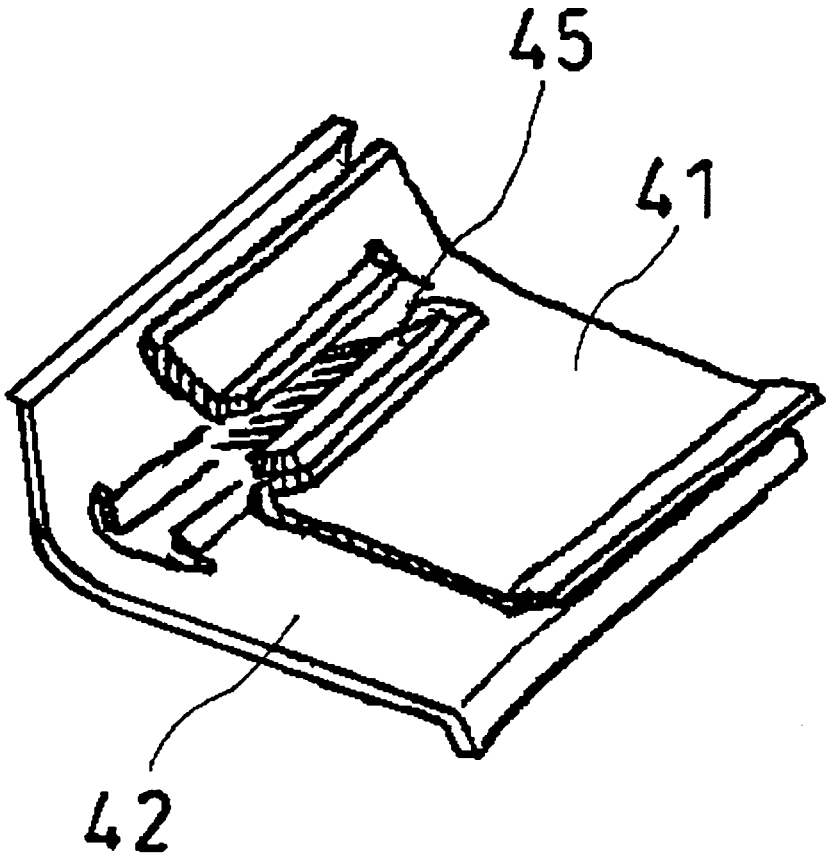
FIG. 3A is a perspective view of a lower sheet guide of a sheet conveying unit provided in the laser copying machine shown in FIG. 1.
Figure 3B:
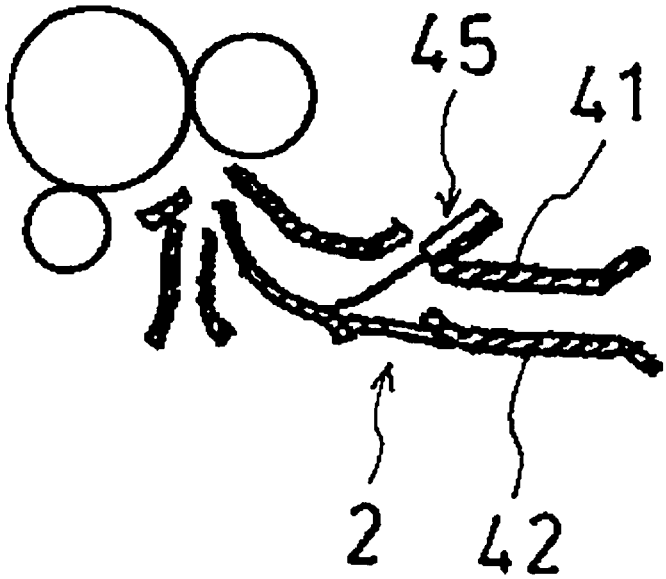
FIG. 3B is a sectional view of the lower sheet guide except for a paper dust collector.

The lower sheet guide 42 corresponds to a lower sheet conveying guide described as this invention. As shown in FIGS. 3A and 3B, in the sheet conveying unit 40 that guide a sheet P fed from the large capacity paper feeding apparatus 30 to the paper feeding path C, the upper sheet guide 41 and the lower sheet guide 42 constitute the conveying path F. The upper and lower sheet guides 41 and 42 are provided in the apparatus main unit 10 so as to be opposed to each other, and they are supported on both sides thereof by side plates (not shown). An opening 2 is provided in a direction orthogonal to the sheet conveying direction at a slightly upstream position of the curved portion of the lower sheet guide 42. The upper sheet guide 41 is also provided with a similar opening, and an elastic member 43 (an elastic member formed in a brush shape, a film shape, a blade shape or the like) extends in a direction of the lower sheet guide 42 on the opening and is retained by a retaining member 44 which is then fixed to the upper sheet guide 41.

At this time, the elastic member 43 is set such that a relationship between the minimum sheet propelling force Fp generated when a sheet P is conveyed by a roller pair to contact on the elastic member 43 and the maximum conveying resistance force Rb which is applied to the sheet P by the elastic member 43 always meets Fp>Rb.

A configuration is employed such that paper dust adhered to sheets is scraped off by the elastic member 43 each time the sheet passes through the conveying path F (that is, the elastic member 43 together with the retaining portion 44 constitutes a paper dust removing unit 45 that removes paper dust on a sheet being conveyed).

Such a configuration is employed that a distal end of the elastic member 43 projects so as to contact with the lower sheet guide 42 and it necessarily comes in contact with a sheet P being conveyed.

Figure 4A:
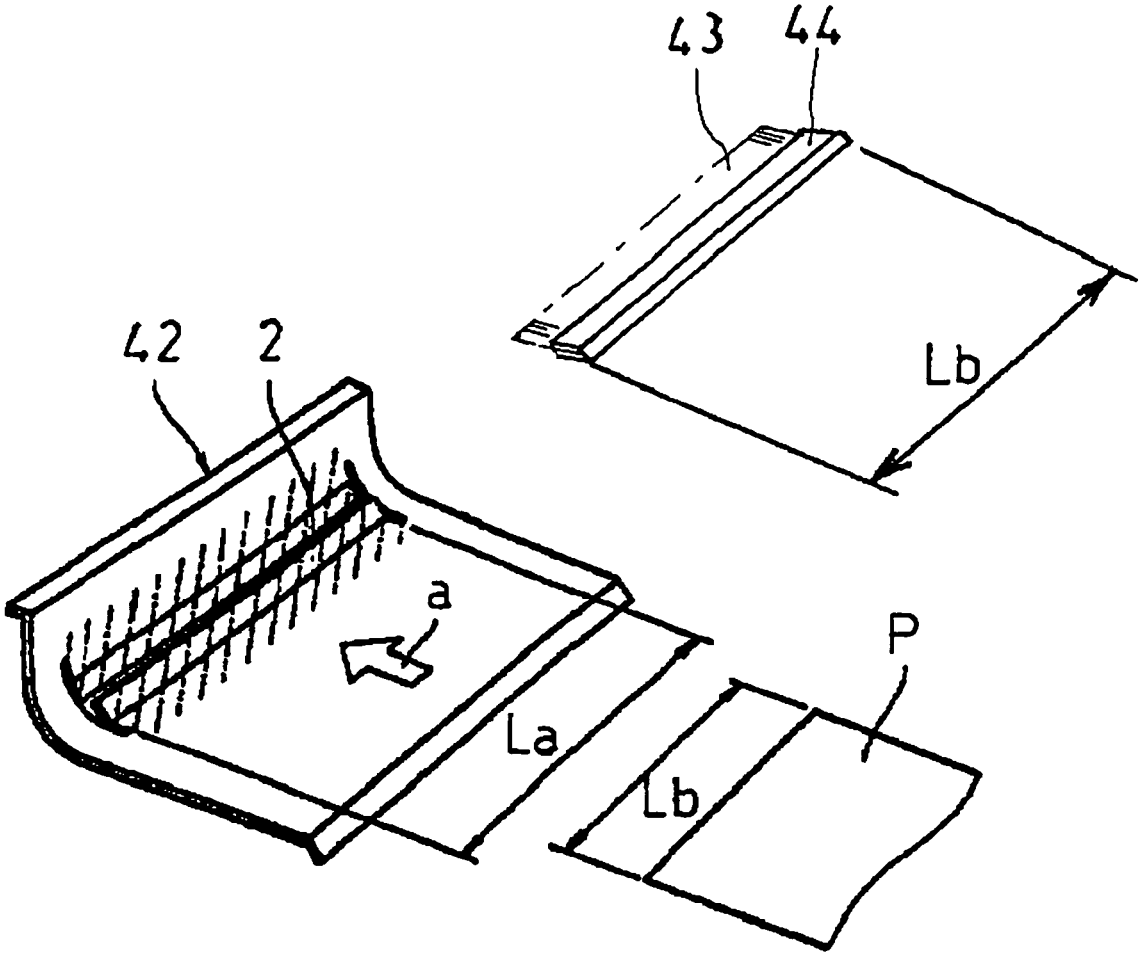
FIG. 4A is an exploded perspective view of a lower sheet guide of the sheet conveying unit provided in the laser copying machine shown in FIG. 1.
Figure 4B:
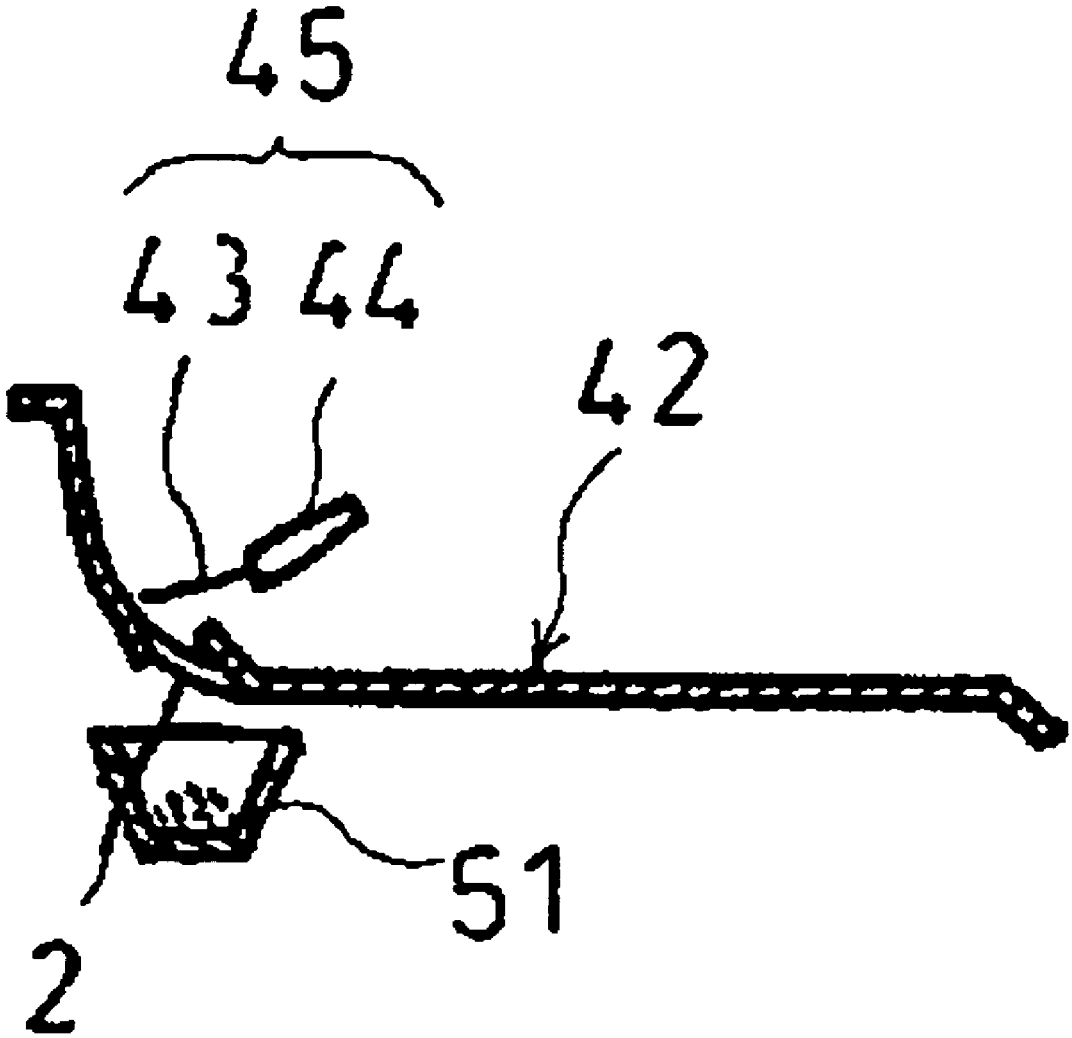
FIG. 4B is a sectional view of the lower sheet guide.

As shown in FIGS. 4A and 4B, a size La, in a widthwise direction, of the opening 2 of the lower sheet guide 42 provided in the direction orthogonal to the sheet conveying direction and a width Lb of the elastic member 43 are set to be sufficiently larger than a maximum sheet width Lp which allows sheet conveyance (La>Lp, Lb>Lp). That is, paper dust on a cut portion of a sheet from which paper dust is most easily generated can be scraped off.

The quality of material for the elastic member 43 retained by the retaining member 44 is constituted of electrically conductive material, material which has been subjected to charging-preventing processing or charging-preventing material (not shown). When the elastic member 43 is constituted from electrically conductive material, the retaining member 44 is also made from electrically conductive material.

As shown in FIG. 4B, a paper dust collector 51 that collects dropping paper dust or the like is provided below the opening 2 of the lower sheet guide 42. The paper dust collector 51 is constituted to be easily drawn alone from the apparatus main unit so as to easily clear the waste such as collected paper dust (not shown).

Figure 5:
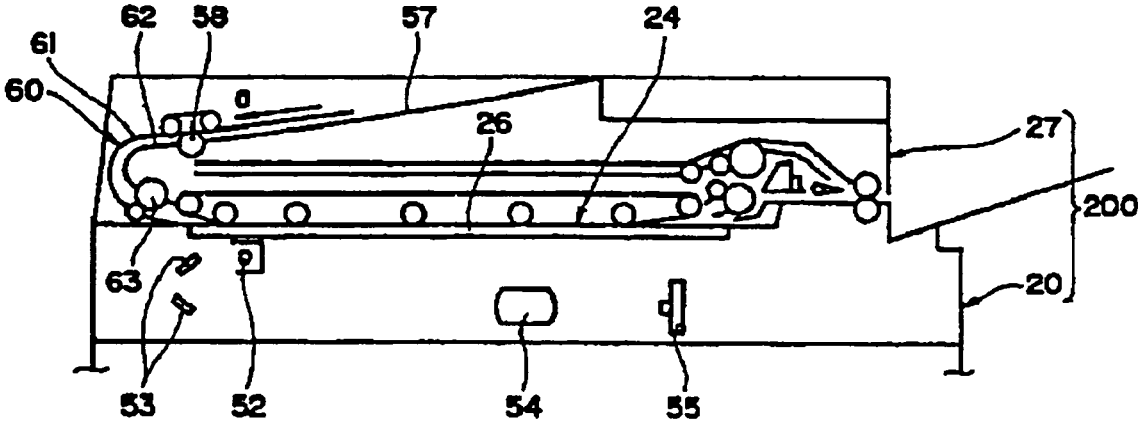
FIG. 5 is an enlarged configurational view of an image reading unit provided in the laser copying machine shown in FIG. 1.

FIG. 5 is an enlarged configurational view of the image reading unit 200 of the laser copying machine shown in FIG. 1.

As described above, the image reading unit 200 is constituted of the optical reader 20 and the ADF 27.

The optical reader 20 includes a light source 52, a plurality of mirrors 53, an imaging lens 54, an image sensor 55 such as CCD, and the like. The contact glass 26 is provided on the image reading unit 24 positioned on an upper surface of the optical reading unit 20.

On the other hand, the ADF 27 is provided with a document set table 57 on which sheet documents (sheet materials) are set from the above, a paper feed roller 58 that feeds the sheet documents one by one, and a sheet conveying unit 60 that reverses the fed document to convey the same to the image reading unit 24. The sheet conveying unit 60 is constituted of a pair of sheet guides 61 and 62 and a pair of conveying rollers 63, and is provided at an upstream position of the image reading unit 24 in a sheet conveying direction "a".

At an image reading time, the paper feed roller 58 is rotated to feed the sheet documents set on the document set table 57 one by one and convey the sheet document to the image reading unit 24 by the conveying roller 63 while guiding the same by the sheet guides 61 and 62, thereby setting them on the contact glass 26. The light source 52 is then moved along the contact glass 26, and light from the light source 52 is sequentially irradiated on a document surface to reflect a reflected light from the document surface on the mirror 53 while moving the mirror 53. The reflected light from the mirror 53 is imaged by the imaging lens 54 and light signal is converted to electric signal by the image sensor 55 to read image information or data on the document surface.

In the image reading unit 200 shown in FIG. 5, the lower sheet guide 61 positioned on a lower side, when a sheet document is reversed, is the sheet conveying guide according to the present invention. Though not shown, the lower sheet guide 61 is also provided with the opening 2, a paper dust removing unit 45, and the like, which are similar to the lower sheet guide 42 shown in FIG. 3, for example.

Figure 6:
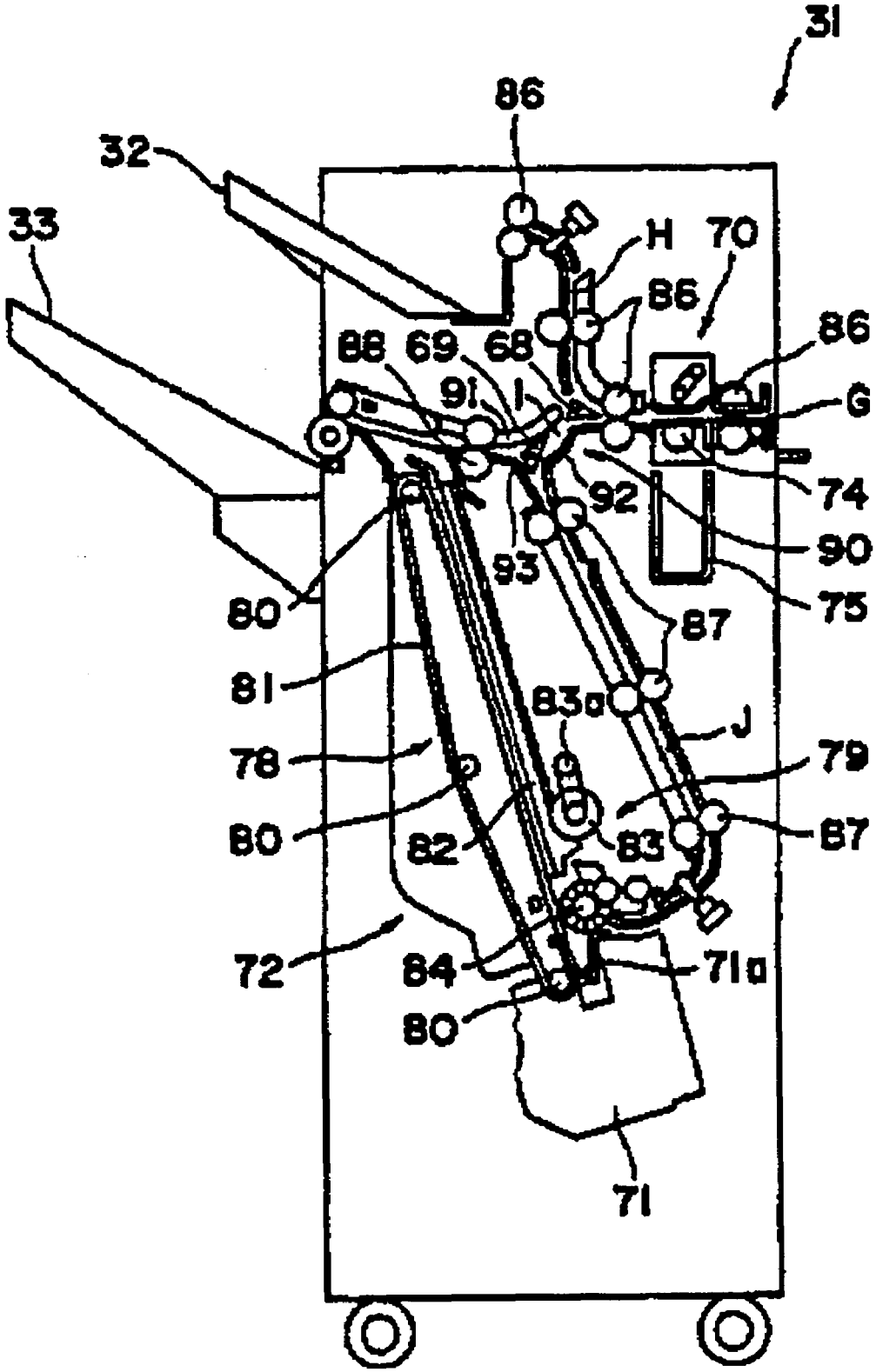
FIG. 6 is an enlarged configurational view of a post-processing unit provided in the laser copying machine shown in FIG. 1.

FIG. 6 is an enlarged view of a post-processing unit 31 of the laser copying machine shown in FIG. 1.

The post-processing unit 31 is provided with a post-processing conveying path G continuous from the sheet discharging path D of the copying machine main unit 10 shown in FIG. 1. The post-processing unit 31 is also provided with a post-processing discharging path H continuous from a position of a tray branching projection 68 of the post-processing conveying path G toward the fixed tray 32 and a post-processing discharging path I extending toward the movable tray 33.

Further, the post-processing unit 31 is provided with a staple conveying path J branched from a position of a staple branching projection 69 provided at a midway of the post-processing discharging path I to join the post-processing discharging path I again.

The post-processing unit 31 includes a sheet conveying unit 90 downstream of the position of the tray branching projection 68. The sheet conveying unit 90 is constituted of an upper sheet guide 91, lower sheet guides 92 and 93, a pair of conveying rollers 88 and the staple branching projection 69.

Such a post-processing unit 31 includes a punching unit 70, a stapling unit 71, an intermediate tray 72, and the like in addition to the fixed tray 32, and movable tray 33 described above.

The punching unit 70 includes a punching roller 74 having a pin (not shown), a dust collector 75, and the like. The stapling unit 71 includes a stapler (not shown) that staples sheet materials and the like. The intermediate tray 72 includes a conveying unit 78, an aligning unit 79, and the like.

The conveying unit 78 is provided with, for example, three rollers 80, where a belt 81 is entrained about the three rollers. A sheet material is temporarily held at an intermediate tray position 82 on the belt 81.

The aligning unit 79 includes a nudger roll 83 that performs alignment of a sheet material held at the intermediate tray position 82 in the sheet conveying direction and in a direction perpendicular to the sheet conveying direction. The aligning unit 79 also includes an aligning roller 84 that performs alignment of the sheet material in the conveying direction, a vertical direction aligning unit (not shown) that performs alignment of the sheet material in the direction perpendicular to the sheet conveying direction, and the like.

In such a post-processing unit 31, when a post-processing is not performed, the tray branching projection 68 is pivoted to one of the fixed tray 32 and the movable tray 33, and the staple branching projection 69 is pivoted to the movable tray 33 side.

Thereafter, the sheet material with the formed image which is sent from the sheet discharging path D of the copying machine main unit 10 is entered in the post-processing conveying path G and the sheet material is conveyed by the conveying roller 86, so that the sheet material is discharged into the fixed tray 32 or the movable tray 33.

When a post-processing for punching is performed, the tray branching projection 68 is pivoted to the side of one of the fixed tray 32 and the movable tray 33, and the staple branching projection 69 is pivoted to the side of the movable tray 33.

Thereafter, the sheet material with the formed image which is sent from the sheet discharging path D of the copying machine main unit 10 is entered in the post-processing conveying path G and the punching roller 74 is rotated timely with conveyance of the sheet material, so that the sheet material is punched by the pin of the punching roller 74. The punched sheet material is conveyed by the conveying roller 86 and discharged onto the fixed tray 32 or the movable tray 33.

On the other hand, dusts due to punching are collected in the dust collector 75 disposed below the punching roller 74.

When a post-processing for stapling is performed, the tray branching projection 68 is pivoted to the side of the movable tray 33 and the staple branching projection 69 is pivoted to the side of the stapling unit 71.

Thereafter, the sheet material with the formed image which is sent from the sheet discharging path D of the copying machine main unit 10 is entered in the post-processing conveying path G and the sheet material is conveyed to the staple conveying path J by the conveying roller 86 while being guided by the upper and lower sheet guides 91, 92, and 93. Thereafter, the sheet material is further conveyed by the staple conveying roller 87 and is temporarily held at the intermediate tray position 82.

Simultaneously, the aligning unit 79 is actuated to rotate the aligning roller 84 in a counterclockwise direction, the sheet material at the intermediate tray position 82 is pushed on a sheet conveying direction reference position 71*a*, thereby performing alignment in the sheet conveying direction. Simultaneously, the vertical direction aligning unit is also actuated to perform alignment in the direction orthogonal to the sheet conveying direction. Simultaneously therewith, the nudger roll 83 is repeatedly rotated about a shaft 83*a* to nudge the sheet material at the intermediate tray position 82, thereby performing alignment in the sheet conveying direction/the direction orthogonal to the sheet conveying direction.

Similarly, a predetermined number of sheet materials are held at the intermediate tray position 82. Thereafter, after the aligning unit 79 is stopped, the stapler of the stapling unit 71 is actuated to perform stapling on the sheet materials at the intermediate tray position 82.

One driving roller of the three rollers 80 in the conveying unit 78 is then rotationally driven and the remaining two idle rollers are dependently rotated, thereby rotating the belt 81 in the counterclockwise direction on FIG. 6. The sheet materials held at the intermediate tray position 82 is discharged onto the movable tray 33 according to rotation of the belt 81.

Finally, the movable tray 33 is moved downwardly corresponding to the discharged sheet materials for receiving sheet materials to be discharged next.

In the post-processing unit 31 shown in FIG. 6, one lower sheet guide 92 which is positioned at the lower side when a sheet material is entered in the post-processing discharging path I is the sheet conveying guide described as the invention. Though not shown, the lower sheet guide 92 also includes an opening 2 and a paper dust removing unit 45 like the lower sheet guide 42 shown in FIG. 3.

According to the first aspect of the invention, it is made possible to scrape off paper dust adhered to a sheet by the elastic member effectively with a simple and low cost configuration, so that image quality or conveying performance can be maintained over a long period of time.

According to the second aspect of the invention, operational advantage similar to the first aspect can be achieved and paper dust adhered to a sheet can be securely scraped off.

According to the third aspect of the invention, operational advantage similar to the first or the second aspect can be achieved, and paper dust on all sheets conveyed on the sheet conveying guide can be securely scraped off with a simple configuration, and image quality or conveying performance can be more effectively maintained over a long period of time.

According to the fourth aspect of the invention, operational advantage similar to any one of the first to the third aspects can be achieved, and conveyance easiness of a sheet and image quality at a post step can be kept well by removing electrostatic charge on a sheet surface generated during conveyance thereof and paper dust adhered to the sheet can be scraped off. Therefore, the cost in the entire machine including the sheet conveying unit can be reduced, as one part serves two roles.

According to the fifth aspect of the invention, operational advantage similar to any one of the first to the third aspects can be achieved, and the paper dust removing performance of the elastic member can be maintained over a long period of time.

According to the sixth aspect of the invention, operational advantage similar to any one of the first to the fifth aspects can be achieved, and paper dust dropping from the opening of the sheet conveying guide can be prevented from scattering inside the sheet conveying unit to contaminate respective units or to contaminate respective units such as the paper feeding unit positioned below the sheet conveying unit, because paper dust is collected in the collector. Accordingly, image quality or conveying performance in the image forming apparatus can be maintained over a long period of time.

According to the seventh aspect of the invention, an image forming apparatus having each advantage described in any one of the first to the sixth aspects can be provided.

According to the eighth aspect of the invention, an image reading unit having each advantage described in any one of the first to the sixth aspects can be provided.

According to the ninth aspect, a post-processing unit having each advantage described in any one of the first to the sixth aspects can be provided.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A sheet conveying unit comprising a lower sheet conveying guide on which a sheet material is placed, the sheet conveying unit conveying the sheet material while the sheet material is being guided by the lower sheet conveying guide, wherein the lower sheet conveying guide includes an opening, an elastic member projecting from above toward the lower sheet conveying guide is provided at a downstream side of the opening, and a width of the opening is set to be larger than one half a width of the lower sheet conveying guide.

2. The sheet conveying unit according to claim 1, wherein a distal end of the elastic member is in contact with the lower sheet conveying guide.

3. The sheet conveying unit according to claim 1, wherein the opening extends in a direction perpendicular to a sheet conveying direction, and a width of the elastic member is set to be larger than the one half the width of the lower sheet conveying guide.

4. The sheet conveying unit according to claim 1, wherein the elastic member is made of an electrically conductive material.

5. The sheet conveying unit according to claim 1, wherein a charging-preventing process is conducted on the elastic member, or the elastic member is made of a charging-preventing material.

6. The sheet conveying unit according to claim 1, wherein a collector that collects paper dust is provided below the opening.

7. An image forming apparatus, comprising a sheet conveying unit that includes a lower sheet conveying guide on which a sheet material is placed, the sheet conveying unit conveying the sheet material while the sheet material is being guided by the lower sheet conveying guide, wherein the lower sheet conveying guide includes an opening, an elastic member projecting from above toward the lower sheet conveying guide is provided at a downstream side of the opening, and a width of the opening is set to be larger than one half a width of the lower sheet conveying guide.

8. An image reading unit, comprising a sheet conveying unit that includes a lower sheet conveying guide on which a sheet material is placed, the sheet conveying unit conveying the sheet material while the sheet material is being guided by the lower sheet conveying guide, wherein the lower sheet conveying guide includes an opening, an elastic member projecting from above toward the lower sheet conveying guide is provided at a downstream side of the opening, and a width of the opening is set to be larger than one half a width of the lower sheet conveying guide.

9. A post-processing unit, comprising a sheet conveying unit that includes a lower sheet conveying guide on which a sheet material is placed, the sheet conveying unit conveying the sheet material while the sheet material is being guided by the lower sheet conveying guide, wherein the lower sheet conveying guide includes an opening, an elastic member projecting from above toward the lower sheet conveying guide is provided at a downstream side of the opening, and a width of the opening is set to be larger than one half a width of the lower sheet conveying guide.

10. A sheet conveying unit comprising a lower sheet conveying guide on which a sheet material is placed, the sheet conveying unit conveying the sheet material while the sheet material is being guided by the lower sheet conveying guide, wherein the lower sheet conveying guide includes an opening, an elastic member projecting from above toward the lower sheet conveying guide is provided at a downstream side of the opening, and the elastic member is made of an electrically conductive material.

11. A sheet conveying unit comprising a lower sheet conveying guide on which a sheet material is placed, the sheet conveying unit conveying the sheet material while the sheet material is being guided by the lower sheet conveying guide, wherein the lower sheet conveying guide includes an opening, and an elastic member projecting from above toward the lower sheet conveying guide is provided at a downstream side of the opening, wherein a charging-preventing process is conducted on the elastic member, or the elastic member is made of a charging-preventing material.

12. A sheet conveying unit comprising a lower sheet conveying guide on which a sheet material is placed, the sheet conveying unit conveying the sheet material while the sheet material is being guided by the lower sheet conveying guide, wherein the lower sheet conveying guide includes an opening, an elastic member projecting from above toward the lower sheet conveying guide is provided at a downstream side of the opening, and a collector that collects paper dust is provided below the opening.

* * * * *